United States Patent [19]

Lemaire

[11] Patent Number: 4,752,100

[45] Date of Patent: Jun. 21, 1988

[54] CONVERTIBLE CHAIR

[76] Inventor: Jeannine Lemaire, 26 boulevard Jean Jaures, 5400 Nancy, France

[21] Appl. No.: 799,901

[22] Filed: Nov. 20, 1985

[30] Foreign Application Priority Data

Nov. 21, 1984 [FR] France ..... 84 17837
Dec. 18, 1984 [FR] France ..... 84 19495

[51] Int. Cl.[4] ..... A47C 1/02

[52] U.S. Cl. ..... 297/84; 297/330; 297/DIG. 10

[58] Field of Search ..... 297/84, 64, 85, DIG. 10, 297/330

[56] References Cited

U.S. PATENT DOCUMENTS 3,121,589 2/1964 Schliephacke ..... 297/84
4,231,614 11/1980 Schaffer ..... 297/DIG. 10
4,249,774 2/1981 Andreasson ..... 297/330
4,333,681 6/1982 Nelson ..... 297/330

*Primary Examiner*—James T. McCall
*Attorney, Agent, or Firm*—Robert E. Burns; Emmanuel J. Lobato

[57] ABSTRACT

Convertible chair of the kind consisting in a seat, a back and a foot-rest, each mobile with respect to the other and all together, characterized in that in a fixed base that assures the stability of the chair on the ground, is lodged a sole jack and all of the connecting rods that control the tilting of the seat itself, of its back and of the foot-rest, and the operation of the piston of this sole jack controls a main lever that sequentially exerts its action to tilt the back, then, either separately or simultaneously, to tilt the seat, and then, either separately or simultaneously, to tilt the foot-rest; this moving of the main lever itself results from direct contact or through the intermediary of secondary levers, with stops activating the moving of levers, each interdependent on the respective rotating axles of the three parts of the chair, in one direction or the other.

11 Claims, 3 Drawing Sheets

Figure 1:
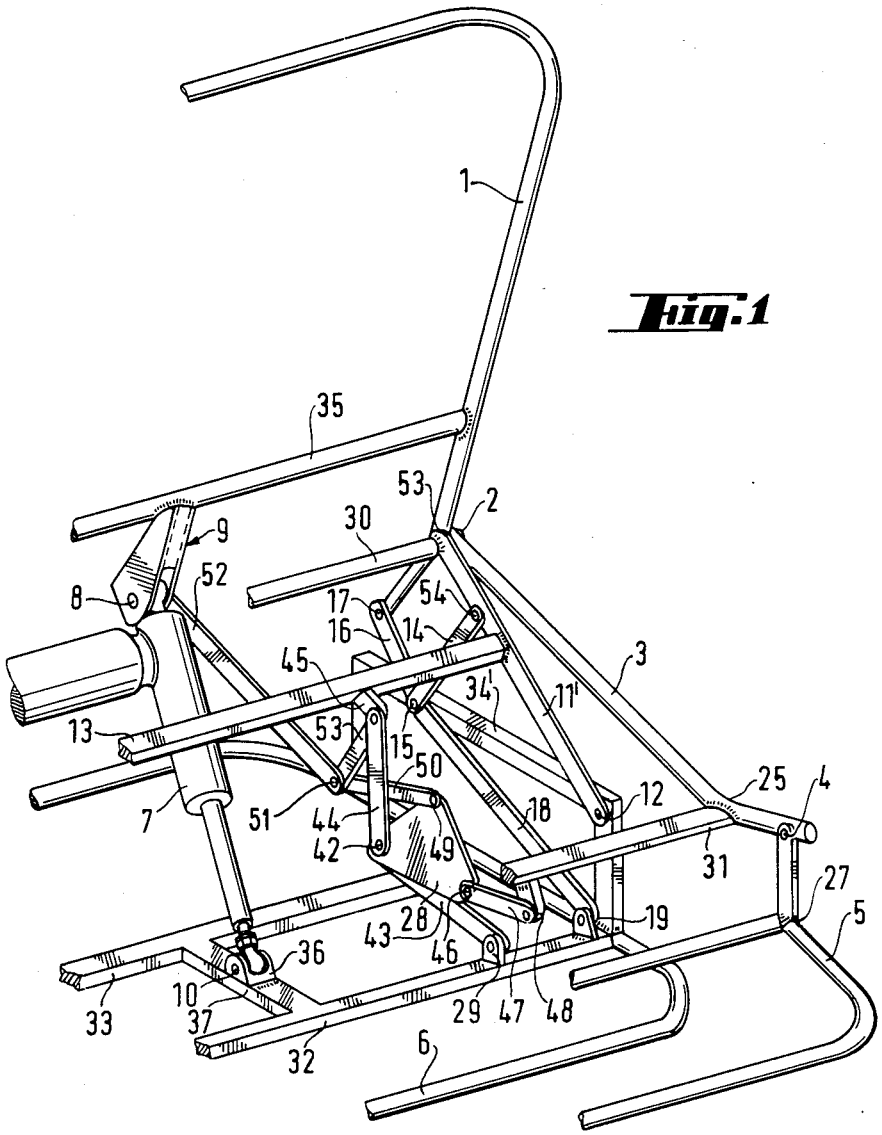

F1
F
F
α
γ
C1
C
β
B
D
E
H
G
H'
δ
D
J
J'
A

CONVERTIBLE CHAIR

The present invention concerns automatic convertible chairs, destined first of all for elderly or handicapped persons, but the use of which is becoming more and more widespread with the perspectiv of making everyday life more comfortable.

These chairs are generally composed of, on one hand, a fixed base including a source or sources of energy, generally electrically controlled jacks, and mechanical parts that transmit the movement of these jacks to movable parts, and on the other hand, the movable parts, that can be the back or back-rest, the seat itself and/or the extension of this seat that forms the foot-rest. These different movable parts have various functions that are more or less complementary. For example, the forward tilting of the back, and then of the seat, are complementary to enable an elderly person, or someone who is re-educating his lower limbs that cannot fulfill their normal functions, to easily stand up. To the contrary, to allow a maximum of comfort when one rests, a chair must have a back that tilts backward as well as a foot-rest that lifts. Finally, many relaxation chairs must offer all possible including combinations of the various parts.

To obtain some of these results, many mechanisms have been proposed. However, all known constructions present at least one, if not all, of the following inconveniences:

1. Several sources of energy or controls are most commonly required.
2. An extreme complexity due to the large number of functions that have to be chosen or fulfilled
3. No correlation between the functions and/or their controls
4. The more complex the mechanism is, the more expensive the chair is.

The present invention allows to eliminate all of these inconveniences, and the chair performs a maximum of useful functions.

In order to achieve this effect, the chair according to the invention is composed of a fixed base asuring the stability of the chair on the ground, and in which is provided a sole jack and all of the connecting rods that control the tilting of the seat itself, of the back and of the foot-rest; the operation of the piston of the jack controls a main lever that sequentially activates the tilting of the back, then, either separately or simultaneously, of the foot-rest, and this moving of the main lever itself results from the contact, directly or through the intermediary of a secondary lever, with the stops that activate the tilting of levers that are interdependent on the respective rotating axles of the three parts of the chair mentioned above, in one direction or the other.

More precisely, according to the present invention, the sole jack, that determines all of the distortions of the parts of the chair from the totally horizontal position to the upright position, acts on a sole point of one of these parts, and this part acts as a relay and controls in turn the distortions of all of the parts.

On the other hand, this control is broken down into three kinematic chains that each in turn determines one of the stages of the distortions.

Referring to the lifting manoeuvre of the seat:

the first kinematic chain consists in a parallelogram that activates by its distortion the lifting of the back with respect to the seat, the second kinematic chain consists in a first set of connecting rods assembled to a first triangle which activates the righting of the seat when the triangle turns, as well as its lifting with respect to the base.

the third kinematic chain consists in a second set of connecting rods assembled to a second triangle, that stops the moving of the seat and the lowering of the foot-rest when the triangle turns.

Of course, during the return-to-lying position manoeuvre, the three kinematic chains have reverse roles, in the reverse order.

In the two cases, the operation of the three kinematic chains results from the single movement the point of to which the jack is associated on the movable part of the chair.

According to a supplementary characteristic, a resting-part such as a pillow or padding is slid on to the back so as to ease the movement of the user's back during the chair's distortion.

Figure 2:
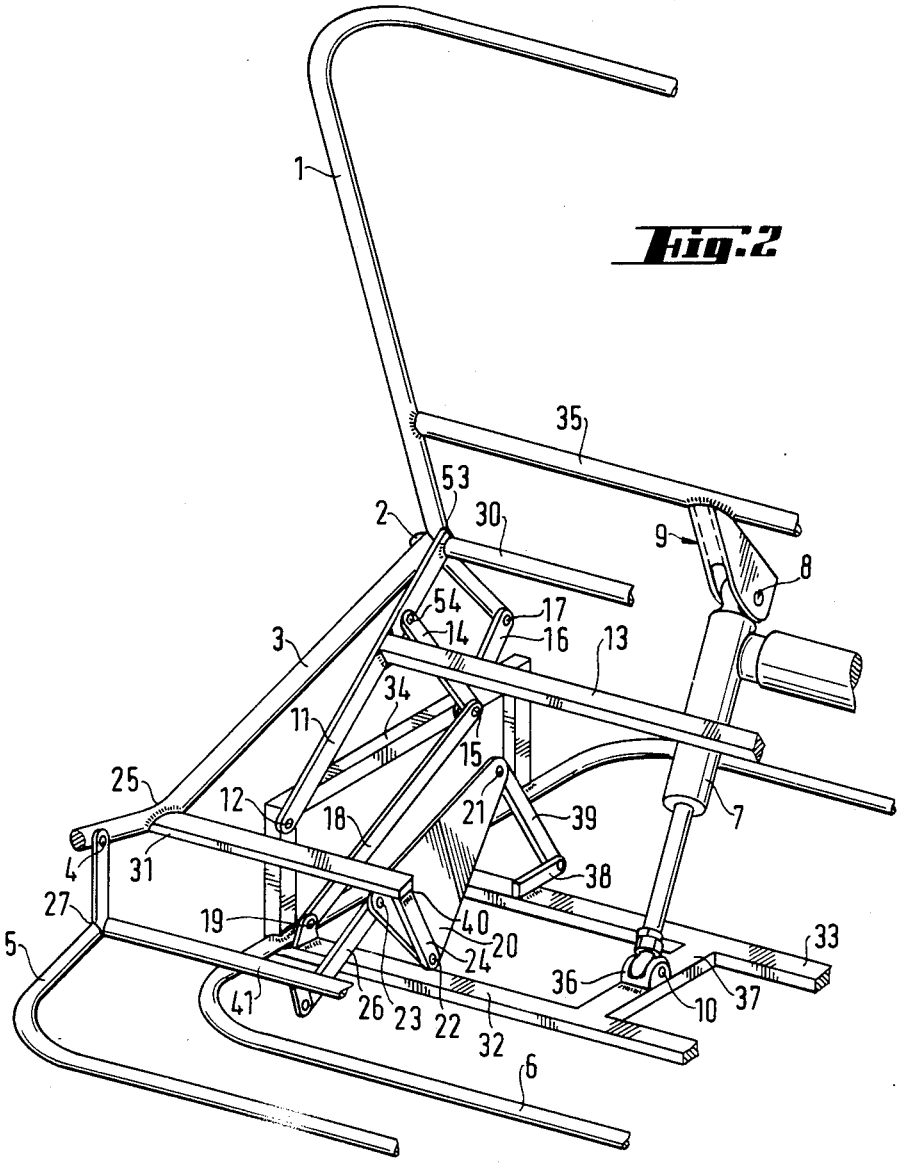
Figure 3:
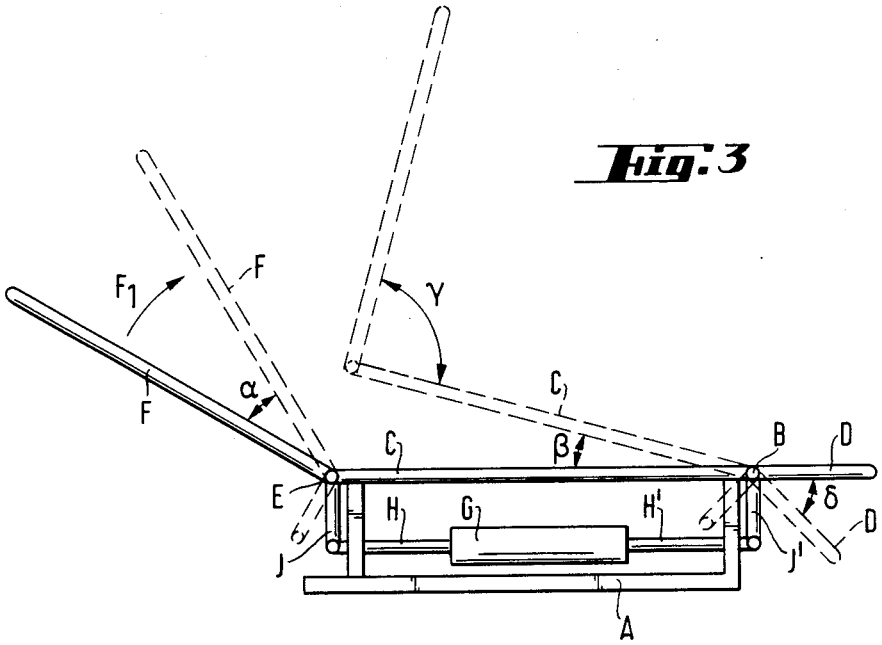

The invention is now going to be described more in detail, reference to the annexed drawing in which:

FIG. 1 is a perspective view of the right part of the mechanism that controls the distortions of the chair according to the invention, FIG. 2 is a similar view of the left part, and FIG. 3 is a mechanical layout which illustrates the chair according to the invention and its operation.

First, we will refer to FIG. 3 of the annexed drawings, which schematically shows the operation of the chair according to the invention.

In this drawing, the general reference A indicates a fixed base which is the base of the seat.

Around an axle B, the front side of the part that forms the seat C is articulated to this base.

Around an axle concentric to the axle B, a foot-rest D is articulated and the back F is articulated around an axle E, located in a back side of the seat C.

All of the movements of all of these parts are assured by a sole jack indicated by G, whose piston H, H' operates the levers indicated by J and J''; the pushing of these levers makes the axles B and E rotate so as to simultaneously tilt the parts of the chair associated to the chair.

The fundamental operation of the chair is the following:

First, the piston H pushes the lever J which makes the back F turn in the direction of an arrow $F_1$ at an angle indicated by $\alpha$. At this point, the same piston H pushes a stop to which the piston reaches, and this tilts the seat C in the same direction $F_1$ at an angle B at the same time. Meanwhile, according to the chosen connecting rods,either the back F remains fixed with respect to seat C, or it also tilts in the same direction $F_1$ until it comes to an angle $\gamma$.

Finally, the piston H reaches another stop which cooperates with a lever similar to the lever J', and pushes a sleeve (not shown on the drawing) co-axial to the axle B. The sleeve will always be able to turn the foot-rest D in the direction $F_1$ with an angle $\beta$.

We will therefore have obtained the successive and/or simultaneous tilting of the three parts of the chair, each at the desired angle, and with the single choice of a connecting rod and of the corresponding stops by the sole jack G, and this enables to transmit the movement of the piston H to the levers interdependent on the axles of the three parts. The pushing of these levers causes the turning of the axles, and subsequently the moving of the concerned parts.

Of course, the operation of the jack G in the opposite direction, will also cause the moving of the three parts in the opposite direction, with the same advantages, i.e. moving together or simultaneously, and each moving to the chosen angle.

The advantages of such a system are obvious compared to all known mechanisms:

There is only one jack G with one control means, for example, a button placed near the hand of the chair's occupant, and the occupant will be able to determine the arrangement and the placing of the different parts of the chair with only one manoeuvre, In spite of the large number of functions to be accomplished, the sole manoeuvre, through an extremely simple mechanism composed of a lever and a sole connecting rod together with the appropriate stops, permits these preprogrammed functions.

The correlation during the operation is determined by the distribution of the stops with respect to the levers and to the connecting rods.

This simplicity results in an extremely low cost for manufacturing such a chair in spite of the remarkable services it renders.

Of course, the illustration of the mechanism according to the invention given here is totally schematized, and the mechanisms allowing to obtain the results described are a bit more complex, as it appears in FIGS. 1 and 2 which illustrate a kind of effective realization of this (or these) mechanism(s), such as described in the introduction of the present invention.

It is understood that, even if the jack 7 appears on both of the FIGS. 1 and 2, the mechanism has only one jack controlled by a sole button by the user.

On the contrary, even though this mechanism may have only one group of parts corresponding ot the first kinematic chain, it would be better if two such groups were installed and distributed symmetrically on each side of the seat as shown in the two figures.

Referring to FIGS. 1 and 2, the mechanism according to the invention focuses on the distorion or displacement of three basic parts each having a generally rectangular form as shown in the figures in the upright position:

a back 1 extending backwards at 53 a seat 3 curved upwards at 25 a foot-rest 5 curved upwards at 27.

The lateral parts of the three parts are linked by horizontal crosspieces, which will be indicated in the description.

The back 1 is articulated to the seat 3 around axles 2 located in the curve and at the extension of a crosspiece 30.

The foot-rest 5 is articulated to the seat 3 around axles 4 at its end.

The seat 3 is reinforced at its curve 25 by a crosspiece 31, that is also used as attaching point for some of the kinematic chain parts.

Finally, the movable group 1, 3, 5 supported, through the intermediary of the kinematic chains, by a base composed of a horizontal frame 6 reinforced by crosspieces 32 and 33 and the two vertical rectangular frames 34 and 34'.

The operation of the mechanism results from the actuation of the sole jack 7 attached to an axle 8 held by a support 36, interdependent on a brace 37 linking the crosspieces 32 and 33.

On each side of the seat, i.e. approximately in the vertical plane of each frame 34, 34', the first kinematic chain is assembled.

The first kinematic chain is composed of a main lever 11 (or 11') articulated at the axle 2 and also articulated at a fixed point 12 of the frame 34 (or 34'). The main levers 11 and 11' are linked by a horizontal crosspiece 13, and a distortable assembly of connecting rods 14, 16, 18 is assembled so that the connecting rod 14 turns at one end thereof at an intermediary point 54 of the lever 11. At the other end 15 thereof, it is rotatively attached to the end of the connecting rod 16 which is also articulated at the base 17 of the back 1, and it is also rotatively attached to the end of the connecting rod 18 which is also articulated a point of 19 the frame 6 of the base.

The operation of this first kinematic chain is as follows:

In order to shift from the low position, totally flat, where the parts 1 to 5 are all arranged in one line, to the upright position, the jack 7 extends and thus, at first, pushes the point 8 and tilts the back 1 forward around the axle 2. When the back 1 reaches a certain position above the seat 3, it stops inclining. Thereafter, as the jack continues to extend, the point 17 to which the connecting rod 16 is articulated keeps moving away from the point 15, and therefore pulls the connecting rod 18 and connecting rod 14. Consequently, when the jack extends, the back continues to rise above the seat, but the seat also slightly moves upwards. Thereafter, when the back has reached its ultimate position, the jack continues to lift the back and seat assembly. At the same time, the point 15 moves away from the connecting rod 11, which results in the assembly 1, 3 remaining fixed one with respect to the other, and moves to its final position. The seat is lifted above the fixed base. We can therefore say that the whole lifting of the back and the following lifting of the back and the seat are assured by these parts.

We are now going to describe two other kinematic chains, which provoke the end of the lifting of the seat above the base during the lowering of the foot-rest.

Each of these chains is based on the principle of the controlling triangle. A triangle revolves around one of its apexes with being pushed by a connecting rod attached to an active part of the jack, so that connecting rods attached to its other apexes activate the moving of the seat parts.

In the second kinematic chain, a triangle linkage 20 is articulated at its apex 21 by a connecting rod 39 attached to a fixed point 38 located on a crosspiece 32, i.e. interdependent on the linking point 10 of the jack 7. A connecting rod 24 fixed at a point 40 to the crosspiece 31, is articulated to the other apex 22, while a connecting rod 26 is attached to the crosspiece 26 at a point 41.

The operation of this second chain is then as follows: when the seat 3 tilts forward, the triangle 20 also tilts forward under the pressure of he connecting rod 24; the apex 23 goes down and pulls the connecting rod 26 which in turn pulls the foot-rest 5 down.

In the case of the third kinematic chain, a triangle linkage 28 is articulated by its apex 42 to a connecting rod 43 revolving around a fixed point 29 of the crosspiece 32, and also articulated to a connecting rod 44 revolving around an axle 45 fixed to the crosspiece 13. At the other apex 46 of the triangle, a connecting rod 47 revolves at a point 48 of the crosspiece 31. Finally, a connecting rod 50 is articulated to the third apex 49, and its other end is attached at a point 51 to the end of a lever 52 revolving around the linking point 8 of the jack 7 and the support 9, and is attached to the point 51 to the end of connecting rod 53 also revolving around the axle 45.

The operation of this third chain is therefore as follows: when the jack 7 extends to lift the back and the seat, and to lift up the seat, the connecting rod 50 and the lever 52 constitute a whole lever (the connecting rod 53 only acts as a relay) that pulls the apex 49 of the triangle 28 backwards, and lifts up and revolves around the apex 42. As this apex 42 is also lifted by the connecting rod 44, all of these elements stop the lifting of the seat. On the other hand, the foot-rest will stop pulling inwards because of the action of the second kinematic chain.

At the end of the operation, the chair allows the user to stand up without having to exert any effort. To make this standing movement of the user even easier, a padding with ball-bearings allow the back of the user to slide along the back of the chair. This increases the comfort.

Of course, on the contrary, the user will be able to shift from the upright position to the completely flat or horizontal position, from head to toes, without any effort.

The chair according to the invention had just been described in a particular realization, i.e. a single place chair. Several variations may be realized by making the distance between the two parts shown in FIGS. 1 and 2 longer to make a sofa or a bed with the same advantages. The pillows and padding may also be different, and the arms may hide the control device of the seat mechanism. The present invention includes various improvements aiming at improving the comfortableness of the seat e.g. a telephone, a remote control for an audio-visual installation, a miniature bar or anything analogous.

What is claimed is:

1. A convertible chair of the type having a seat, a back and a foot-rest relatively movable with respect to each other comprising: a fixed base for assuring the stability of the chair on the gound; a sole jack having a piston and an assembly having a main lever and secondary levers, the sole jack and the assembly being provided on the fixed base for controlling tilting of the seat, back and foot-rest; the main lever for sequentially actuating the tilting of the back, then separately or simultaneously actuating the tilting of the seat, and then separately or simultaneously actuating the tilting of the foot-rest in response to the movement of the piston of the sole jack; and stop means for controlling the movement of the main lever by directly contacting the main lever or contacting the main lever through the intermediary of the secondary levers, and for effecting lifting of the levers interdependently of the respective movement of the seat, back and foot-rest.

2. A convertible chair according to claim 1, wherein the sole jack determines all of the positions of the seat, back and foot-rest including completely horizontal position and upright position, and the sole jack acts upon a sole point of one of the seat, back and foot-rest which acts as a relay and commands the positions of the seat, back and foot-rest.

3. A convertible chair according to claim 2, wherein the assembly comprises first, second and third kinematic chains each for determining one of the positions of the seat, back and foot-rest.

4. A convertible chair according to claim 3, wherein the first kinematic chain comprises a parallelogram for righting the back with respect to the seat according to distortion of the parallelogram, the second kinematic chain comprises a first set of connecting rods and a first triangle connected to the first set of connecting rods, the second kinematic chain being operative to stop the movement of the seat and folding back the foot-rest in response to rotation of the first triangle, and the third kinematic chain comprises a second set of connecting rods and a second triangle connected to the second set of connecting rods, the third kinematic chain being operative to right the seat and lift the seat with respect to the fixed base.

5. A convertible chair according to claim 1, including a supporting part slidably attached to the back so as to ease the moving of the user's back during the operation of the convertible chair.

6. A convertible chair comprising: a base; a seat having opposite ends and movably supported by the base so as to be declined forward; axles disposed at one end of the seat; a back rotatively engaged with the axles so as to be selectively positionable in a horizontal position and in a vertical position; a foot-rest rotatively engaged with the other end of the seat; a sole jack connected between the back and the base for actuating the back; and kinematic means connected between the back, seat and foot-rest for effecting cooperative movements of the back, seat and foot-rest in response to the movement of the back so as to selectively arrange the back, seat and foot-rest in a totally flat position where the back, seat and foot-rest are aligned in a horizontal plane, an upright position where the back and foot-rest are vertically aligned and the seat is declined forward, and intermediate positions between the totally flat position and the upright position.

7. A convertible chair according to claim 6; wherein the kinematic means comprises a first kinematic chain connected between the back and the seat for righting the back with respect to the seat and for forwardly declining the seat with respect to the base in response to forward rotation of the back; a second kinematic chain connected between the seat and the foot-rest for forwardly rotating the foot-rest with respect to the seat in response to the declining movement of the seat; and a third kinematic chain connected between the seat and the base and actuated by the sole jack for righting and lifting the seat with respect to the base in response to the forward rotation of the back.

8. A convertible chair according to claim 7; wherein the first kinematic chain comprises a parallelogram actuated by the back.

9. A convertible chair according to claim 7; wherein the second kinematic chain comprises a first triangle linkage rotated by the seat.

10. A convertible chair according to claim 7; wherein the third kinematic chain comprises a second triangle linkage rotated by the sole jack.

11. A convertible chair according to claim 6; wherein the sole jack extends along the lengthwise axis thereof so as to forwardly rotate the back.

* * * * *